United States Patent [19]

Harase et al.

[11] 4,225,366

[45] Sep. 30, 1980

[54] PROCESS FOR PRODUCING GRAIN ORIENTED ELECTRICAL SILICON STEEL SHEET CONTAINING ALUMINIUM

[75] Inventors: Jirou Harase, Fukuoka; Shozaburo Nakashima; Yasukazu Mori, both of Kitakyushu, all of Japan

[73] Assignee: Nippon Steel Corporation, Japan

[21] Appl. No.: 75,673

[22] Filed: Sep. 13, 1979

[30] Foreign Application Priority Data

Oct. 2, 1978 [JP] Japan ..... 53-120440

[51] Int. Cl.[2] ..... H01F 1/04

[52] U.S. Cl. ..... 148/111; 148/113

[58] Field of Search ..... 148/110, 111, 112, 113

[56] References Cited

U.S. PATENT DOCUMENTS

| | | | |
|---|---|---|---|
| 3,764,406 | 10/1973 | Littmann | 148/110 |
| 3,846,187 | 11/1974 | Sakakura et al. | 148/112 |
| 4,030,950 | 6/1977 | Shilling et al. | 148/111 |
| 4,118,255 | 10/1978 | Barisoni et al. | 148/111 |

*Primary Examiner*—L. Dewayne Rutledge
*Assistant Examiner*—John P. Sheehan
*Attorney, Agent, or Firm*—Wenderoth, Lind & Ponack

[57] ABSTRACT

A grain oriented electrical silicon steel sheet containing aluminium and having an extremely high magnetic flux density, for example, a B8 of 1.90 or more, is produced by a secondary recrystallization annealing operation in which, during the period of elevating the temperature of a reducing atmosphere to a level within a range of from 850° to 950° C., the partial pressure of nitrogen in the reducing atmosphere is limited to 20% or less based on the entire pressure of the reducing atmosphere, and during the period of elevating the temperature of the reducing atmosphere in which the secondary recrystallization is in progress, the partial pressure of nitrogen is maintained at a level of at least 3%.

3 Claims, 10 Drawing Figures

Fig. 2a (COMPARISON)
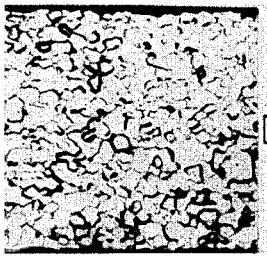
Fig. 2b (COMPARISON)
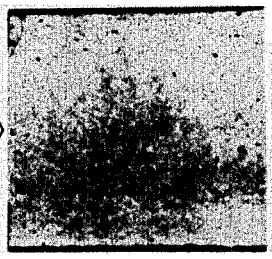
Fig. 2c (COMPARISON)
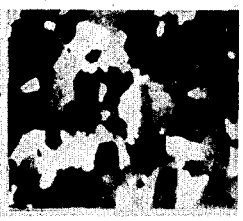
Fig. 3a
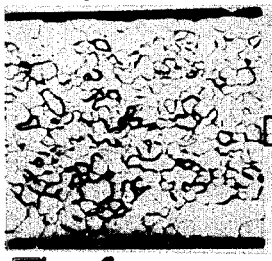
Fig. 3b
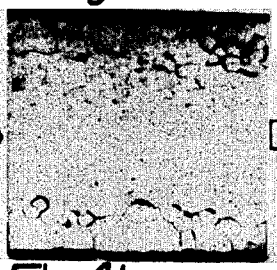
Fig. 3c
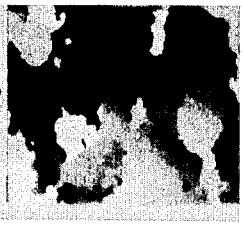
Fig. 4a (COMPARISON)
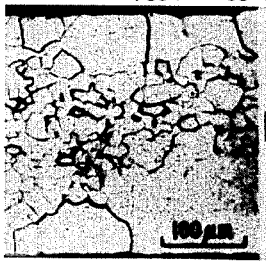
Fig. 4b (COMPARISON)
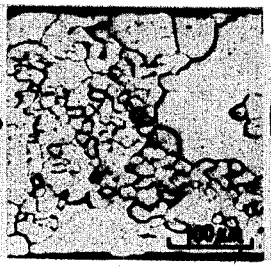
Fig. 4c (COMPARISON)
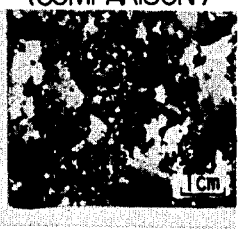

PROCESS FOR PRODUCING GRAIN ORIENTED ELECTRICAL SILICON STEEL SHEET CONTAINING ALUMINIUM

FIELD OF THE INVENTION

The present invention relates to a process for producing a grain oriented electrical silicon steel sheet containing aluminium. More particularly, the present invention relates to a process for producing a grain oriented electrical silicon steel sheet containing aluminum and having an extremely high magnetic flux density.

BACKGROUND OF THE INVENTION

In a conventional process, a grain oriented electrical silicon steel sheet containing aluminium is produced in the following manner.

A melt of silicon steel which has been produced by using a conventional steel-making furnace is cast to form an ingot by a conventional ingot method or a slab by a continuous casting method, and in the case of a formed ingot the ingot is converted into a slab, if necessary. The slab is hot rolled and, then, cold rolled once or twice to form a steel sheet having a desired dimension. The hot rolled sheet is composed of 2.5 to 4.0% by weight of silicon, 0.02 to 0.085% by weight of carbon, 0.010 to 0.06% by weight of aluminium, 0.002 to 0.010% of nitrogen and the balance consisting of iron and inevitable impurities. The steel sheet may contain a desired amount of mangnese and sulfur and, optionally, a small amount of Se, Te, Sb, Sn, Pb, V, Cr, Ni, Cu and/or B. Before the above-mentioned cold rolling operation, the hot rolled steel sheet may be subjected to an intermediate annealing operation in order to allow AlN to be uniformly distributed and precipitated in the steel sheet. The cold rolled steel sheet is subjected to a decarburization operation, shaped into a desired shape, usually, the shape of a coil, coated with an annealing separator comprising MgO and, then, subjected to a batch type final annealing operation in which the secondary recrystallization of the steel sheet occurs.

Attempts have been made to produce an electrical silicon steel sheet having an extremely high magnetic flux density $B_8$ of 1.90 or more at a magnetizing force of 800 A/m, by applying such a secondary recrystallization annealing operation that the silicon steel sheet is heated in a reducing atmosphere containing a predetermined amount of nitrogen until the temperature of the reducing atmosphere reaches a level at which the secondary recrystallization of the steel sheet is completed.

Japanese patent application laying-open (Kokai) No. 50-134917 discloses another method for increasing the magnetic flux density of the steel sheet during the final annealing operation. In this method, the dew point of the annealing atmosphere is adjusted so that it is within a special range.

The inventors of the present invention have studied the above-mentioned prior art methods and, based on those methods, have created an improved method for producing an electrical silicon steel sheet having an extremely high magnetic flux density. This is, the inventors of the present invention have studied in detail the secondary recrystallization behaviour of the steel sheet in relation to the precipitation and disolution behaviour of AlN during the final annealing operation. As a result of their study, it was discovered by the inventors that, in the case of a steel sheet which has been completely secondary recystallized and yet has a poor magnetic flux density, the crystal grains in the steel sheet just before the onset of secondary recrystallization are substantially uniformly distributed in the direction normal to the plane surfaces of the steel sheet. However, in the case of a secondary recrystallized steel sheet having an excellent magnetic flux density, it was found that the crystal grains located in the surface layer of the steel sheet had grown into coarse crystal grains just before the onset of secondary recrystallization and the nuclei of the secondary crystals were created in bounding regions between the course crystal grains in the surface layer and fine crystal grains in the inside layer of the steel sheet. Also, it was discovered by the inventors that the thicker the layer of the coarse crystal grains, the farther the secondary crystal nuclei are located from the outside surface of the steel sheet. As long as the location of the secondary crystal nuclei is within about 60 to 80 microns from the outside surface of the steel sheet, then the farther the secondary crystal nuclei are located from the outside surface of the steel sheet, the higher the magnetic flux density of the resultant secondary recrystallized steel sheet. However, when the location of the secondary crystal nuclei is about 90 microns or more from the outside surface of the steel sheet, it becomes difficult to cause secondary recrystallization. That is, during the secondary recrystalling operation, the so-called fine crystal grains are generated in the steel sheet, and the resultant steel sheet exhibits a remarkably poor magnetic flux density. Furthermore, it was discovered by the inventors that, since the coarsening of the crystal grains located in the surface layer of the steel sheet is promoted by the reduction in concentration of AlN in the surface layer during the final annealing operation, the thickness of the coarse crystal grain layer can be controlled by controlling the concentration of AlN in the surface layer of the steel sheet during the final annealing operation. It is possible to promote a reduction in the concentration of AlN near the surface layer of the steel sheet during the secondary recrystallization annealing operation by slowing down the heating rate, however, the productivity in the final annealing has to be lowered. The present invention makes it possible to lower the concentration of AlN the surface layer even under a higher rate of heating than that of a conventional annealing process leading to the increase of productivity in the final annealing proces.

The present invention has been attained based on the above-mentioned discoveries.

SUMMARY OF THE INVENTION

An object of the present invention is to provide a process for producing a grain oriented electrical silicon steel sheet containing aluminium and having an extremely high magnetic flux density.

Another object of the present invention is to provide a process for producing a grain oriented electrical silicon steel sheet containing aluminium at a high rate of productivity by making it possible to increase the heating rate in the final annealing process without causing deterioration of the magnetic properties of the final products.

The above-mentioned objects can be attained by the process of the present invention, which comprises secondary recrystallization annealing of a silicon steel sheet containing aluminium, which has been cold rolled, and then, decarburization annealed, and which process is characterized in that, in the secondary recrystallization annealing operation, during the time of elevating the temperature of said reducing atmosphere to a level in a range of from 850° to 950° C., the content of nitrogen in said reducing atmosphere is limited to such an extend that the partial pressure of nitrogen is 20% or less based on the entire pressure of said reducing atmosphere and, then, during the time of elevating the temperature of said reducing atmosphere from a level at which the secondary recrystallization of said steel sheet is started to a level at which the secondary recrystallization of said steel sheet is completed, the content of nitrogen in said reducing atmosphere is maintained at such a level that the partial pressure of nitrogen is at least 3% based on the entire pressure of said reducing atmosphere.

BRIEF DESCRIPTION OF DRAWINGS

FIG. 2*a* is a microscopic photograph showing a cross-sectional view of a silicon sheet at a stage just before the onset of a secondary recrystallization annealing in a reducing atmosphere at a temperature of 950° C.

FIG. 2*b* is a microscopic photograph showing a cross-sectional view of the same silicon steel sheet as that in FIG. 2*a*, at a stage at which the secondary recrystallization annealing is almost completed.

FIG. 2*c* is a microscopic photograph showing a macro structure of the same silicon steel sheet as that in FIG. 2*b* after the secondary recrystallization annealing has been completed.

FIG. 3*a* is a microscopic photograph showing a cross-sectional view of a silicon sheet at a stage just before the onset of a secondary recrystallization annealing in a reducing atmosphere having a content of nitrogen falling within the scope of the present invention, at a temperature of 1000° C.

FIG. 3*b* is a microscopic photograph showing a cross-sectional view of the same silicon steel sheet as that in FIG. 3*a*, at a stage at which the secondary recrystallization annealing is almost completed.

FIG. 3*c* is a microscopic photograph showing a macro structure of the same silicon steel sheet as that in FIG. 3*b* after the secondary recrystallization annealing has been completed.

FIG. 4*a* is a microscopic photograph showing a cross-sectional view of a silicon steel sheet at a stage just before the onset of a secondary recrystallization annealing in a reducing atmosphere at a temperature of 1000° C.

FIG. 4*b* is a microscopic photograph showing a cross-sectional view of the same steel sheet as that in FIG. 4*a*, at a stage at which the secondary recrystallization annealing in a reducing atmosphere is in progress at a temperature of 1025° C.

FIG. 4*c* is a microscopic photograph showing a macro structure of the same silicon steel sheet as that in FIG. 4*b* after the secondary recystallization has been completed.

DETAILED DESCRIPTION OF THE INVENTION

Figure 1:
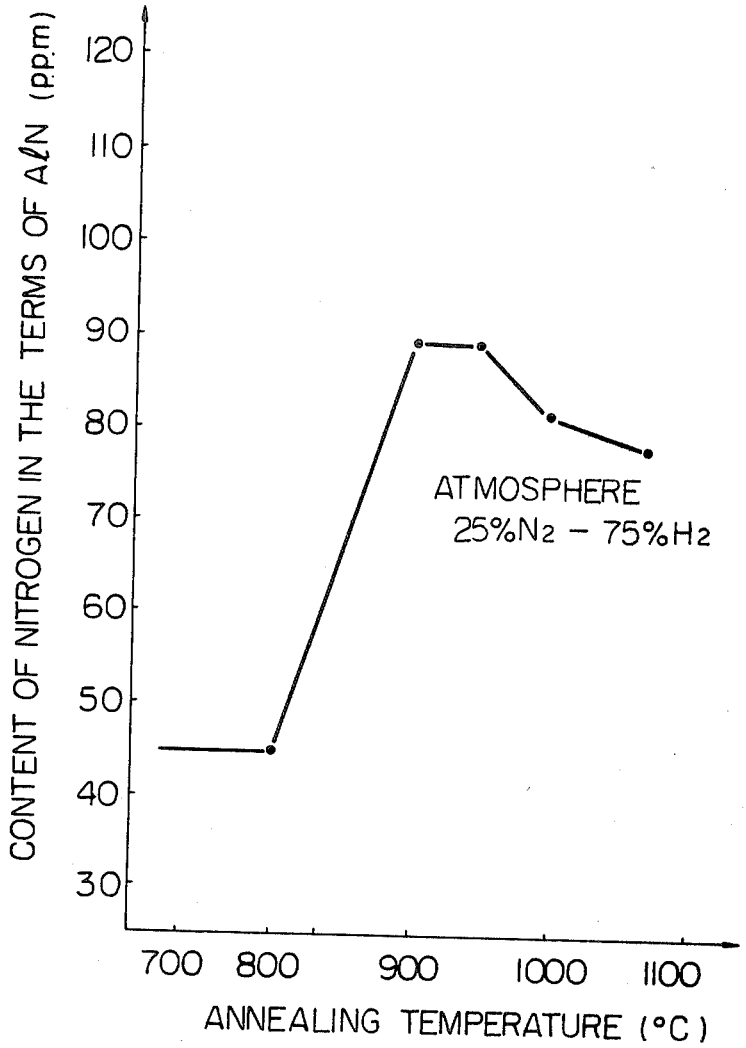
FIG. 1 is a graph showing a relationship between the temperature of the reducing atmosphere of the secondary recrystallization annealing of a silicon steel sheet, and the amount of AlN precipitated in the steel sheet.

In the process of the present invention, a silicon steel sheet which contains aluminium, preferably in an amount of 0.015 to 0.040% by weight, and which has been prepared by cold rolling and, then, decarburization annealing, is subjected to a secondary recrystallization annealing in a reducing atmosphere. The reducing atmosphere contains a reducing gas which is usually hydrogen gas.

The secondary recrystallization annealing operation comprises an initial stage in which the temperature of the reducing atmosphere is elevated to a level within the range of from 850 to 950° C., which is just below the temperature at which the secondary recrystallization of the steel sheet is started, and; a second stage in which the temperature of the reducing atmosphere is elevated from a level at which the secondary recrystallization is stated to another level at which the secondary recrystallization of the steel sheet is completed. The secondary recrystallization-starting and -completing temperatures are slightly higher than 950° C. and about 1100° C., respectively.

The characteristic feature of the process of the present invention resides in the control of the content of nitrogen in the reducing atmosphere during the initial stage, which is separate from the control of the content of nitrogen in the reducing atmosphere during the second stage. That is, during the initial stage, the content of nitrogen in the reducing atmosphere is limited to such an extent that the partial pressure of nitrogen in the reducing atmosphere is 20% or less, preferably, 10% or less, more preferably, 0 to 10%, based on the entire pressure of the reducing atmosphere. Also, during the second stage, the content of nitrogen in the reducing atmosphere is maintained at such a level that the partial pressure of nitrogen in the reducing atmosphere is at least 3%, preferably, at least 10%, more preferably, 10 to 50%, based on the entire pressure of the reducing atmosphere. It is most preferable that in the initial stage, the content of nitrogen in the reducing atmosphere be zero, and in the second stage, the partial pressure of nitrogen in the reducing atmosphere be in a range of from 10 to 50%, based on the entire pressure of the reducing atmosphere.

The process of the present invention is effective for producing an electrical silicon steel sheet having an extremely enhanced magnetic flux density over the sheets of the prior art, for example, a B8 of 1.90 or more.

Also, the process of the present invention is effective for causing the temperature-elevating rate in the initial and second stages in the secondary recrystallization annealing operation to be higher than that in the prior art. This feature also causes the productivity of the electrical silicon steel sheet in the process of the present invention to be higher than that of the prior art.

When a silicon steel sheet containing aluminium is secondary recrystallization annealed in a reducing atmosphere containing 75% by volume of hydrogen and 25% by volume of nitrogen in accordance with the conventional manner, the content of AlN in the steel sheet increases during the annealing operation. FIG. 1 is a graph showing a relationship between the temperature of the reducing atmosphere consisting 75% hydrogen and 25% nitrogen and the amount of AlN precipitated in the steel sheet at the heating stage of the secondary recrystallization annealing process. Referring to FIG. 1, it is clear that the content of nitrogen in terms of AlN remarkably increases during the period of elevating the temperature of the reducing atmosphere from about 800 to 900° C. This remarkable increase of the content of AlN is mainly due to the reaction of nitrogen diffused from the reducing atmosphere into the steel sheet with aluminium in the steel sheet to produce AlN. That is, the larger the content of nitrogen in the reducing atmosphere during the initial period of the secondary recrystallization annealing, the larger the amount of AlN precipitated in the steel sheet. However, in accordance with the process of the present invention, the amount of AlN precipitated in the steel sheet can be maintained at a low level by limiting the partial pressure of nitrogen in the reducing atmosphere to 20% or less, based on the entire pressure of the reducing atmosphere, during the initial steps of the secondary recrystallization annealing operation. During the initial stage, there is the possibility that there will be formed in the surface layer of the steel sheet coarse crystal grains having proper size, that is, 40 microns or less. In this regard, when a steel sheet having therein coarse crystal grains of proper size is subjected to the second stage of the secondary recrystallization annealing, due to the coarse crystal grains formed in the surface layer of the steel sheet, the nuclei of secondary crystal grains are created at a proper distance from the outside surface of the steel sheet. This location of the nuclei of secondary crystal grains causes the secondary recrystallization temperature of the steel sheet to be shifted to a higher temperature than that of the prior art. This high secondary recrystallization temperature is effective for the growth of a Goss's structure which exhibits a very high degree of grain orientation in the steel sheet.

In order to prevent the increase of the precipitation of AlN in the steel sheet, it is preferable that the content of nitrogen in the reducing atmosphere be as small as possible during the initial stage. In this regard, it is most preferable that the reducing atmosphere contain no nitrogen during the initial stage of the secondary recrystallization annealing operation. However, in the initial stage, the reducing atmosphere may contain a minor amount of nitrogen, as long as the partial pressure of nitrogen does not exceed 20%, based on the entire pressure of the reducing atmosphere.

As stated above, in the initial stage, the temperature of the reducing atmosphere is elevated to a level within the range of from 850 ° to 950° C. If in the initial stage the reducing temperature is elevated to a level higher than 950° C., the complete lack of, or low content of, nitrogen in the reducing atmosphere will cause the crystal grains in the surface layer of the steel sheet to be excessively coarsened, and therefore, the seconday recrystallization becomes incomplete, as shown in FIG. 4c. Accordingly, the upper limit of the temperature of the reducing atmosphere in the initial stage of the secondary recrystallization annealing operation must be 950° C.

In the second stage, the temperature of the reducing atmosphere is elevated from a level at which the secondary recrystallization is started, that is, slightly more than 950° C., to another level at which the secondary recrystallization is completed, that is, about 1100° C. During the second stage, the partial pressure of nitrogen in the reducing atmosphere is maintained at the level of 3% or more, based on the entire pressure of the reducing atmosphere. This level of the partial pressure of nitrogen is effective for preventing the excessive coarsening of the crystal grains and for enhancing the selective growth of the Goss's structure having a high degree of grain orientation. The coarse grains formed in the surface layer of the steel sheet cause the secondary recrystallization temperature thereof to be higher than that of the prior arts, resulting in a higher magnetic flux density in the final product than that of the prior arts.

The following examples are intented to illustrate the application of the process of the present invention, but are not intended to limit the scope of the present invention.

EXAMPLES 1 THROUGH 3 AND COMPARISON EXAMPLES 1 THROUGH 4

In each of the Examples 1 through 3 and Comparison Examples 1 through 4, a steel slab having a thickness of 200 mm, which had been produced by a continuous casting method and which contained 0.044% by weight of C, 0.070% by weight of Mn, 0.021% by weight of S, 2.94% by weight of Si, 0.027% by weight of Al and 0.0061% by weight of N, was hot rolled to provide a steel sheet having a thickness of 2.3 mm. The hot rolled steel sheet was annealed at a temperature of 1100° C., for 2 minutes, cold rolled to provide steel sheet having a thickness of 0.3 mm, and then, decarburization annealed. The resultant steel sheet was coated with magnesium oxide and subjected to a final secondary recrystallization annealing, in which the temperature of the reducing atmosphere was elevated at a rate of 25° C./hour to 1200° C., and then, maintained at this level for 20 hours.

In Comparison Example 1, the reducing atmosphere consisted of 75% hydrogen and 25% nitrogen, and the steel sheet was heated in this atmosphere until the temperature of the reducing atmosphere reached 1200° C. Just after the temperature of the reducing atmosphere reached 950° C., the steel sheet exhibited the cross-sectional microscopic view as shown in FIG. 2*a*. FIG. 2*b* shows a cross-sectional microscopic view of the steel sheet just after the temperature of the reducing atmosphere reached 975° C., at which temperature the secondary recrystallization of the steel sheet was started. It is obvious from the view of FIG. 2*b* that the surface layers of the steel sheet contained no coarse crystal grains. The resultant secondary recrystallized steel sheet exhibited a macro structure as shown in FIG. 2*c* and a poor $B_8$ of 1.85.

That is, the structure shown in FIG. 2*a*, in which the distribution of grain size along the thickness of the steel sheet is uniform, results in the structure shown in FIG. 2*b*, in which few coarse grains can be seen near the surface of the steel sheet, and the structure as shown in FIG. 2*b* results in the macro structure shown in FIG. 2*c*, which is an imperfect secondary recrystallization structure and, therefore, results in a poor magnetic flux density of the final product.

In Example 1, the reducing atmosphere consisted 85% hydrogen and 15% nitrogen, and the steel sheet was heated in this atmosphere until the temperature of the reducing atmosphere reached 1200° C. The resultant secondary recrystallized steel sheet exhibited an extremely high $B_8$ of 1.96.

In Example 2, the steel sheet was heated in a reducing atmosphere consisting of hydrogen alone until the temperature of the reducing atmosphere reached 900° C. Then, the steel sheet was heated in another reducing atmosphere consisting of 50% hydrogen and 50% nitrogen until the temperature of the reducing atmosphere reached 1200° C. The resultant secondary recrystallized steel sheet exhibited an extremely high $B_8$ of 1.96.

In Example 3, the steel sheet was heated in a reducing atmosphere consisting of hydrogen alone until the temperature of the reducing atmosphere reached 900° C. Then, the steel sheet was farther heated in another reducing atmosphere consisting of 75% hydrogen and 25% nitrogen until the temperature of the reducing atmosphere reached 1200° C. The steel sheet exhibited a cross-sectional microscopic view as shown in FIG. 3*a* after the temperature of the reducing atmosphere reached 1000° C., which was just below the temperature at which the secondary recrystallization was started, and a cross-sectional microscopic view as shown in FIG. 3*b* after the temperature of the reducing atmosphere reached 1025° C., at which the secondary recrystallization was in progress. It is obvious from the view of FIG. 3*a* that the surface layers of the steel sheet just before the onset of the secondary recrystallization contained coarsened crystal grains. That is, the grain size distribution along the thickness of the steel sheet as shown in FIG. 3*a* is not uniform, in that coarser gains are distributed near the surface of the steel sheet. Also, in FIG. 3*b*, a layer of the coarser grains can be seen near the surface of the steel sheet. In this case the initiation temperature of the secondary recrystallization is about 50° C. higher than that in the case of FIG. 2*b*. The resultant secondary recrystallized steel sheet exhibited a macro structure as shown in FIG. 3*c* and an extremely high $B_8$ of 1.98.

In Comparison Example 2, the steel sheet was heated in a reducing atmosphere consisting of hydrogen alone until the temperature of the reducing atmosphere reached 1000° C. Then, the steel sheet was heated in another reducing atmosphere consisting of 50% hydrogen and 50% nitrogen until the temperature of the reducing atmosphere reached 1200° C. The steel sheet exhibited a cross-sectional microscopic view as shown in FIG. 4*a* after the temperature of the reducing atmosphere reached 1000° C., and a cross-sectional microscopic view as shown in FIG. 4*b* after the temperature of the reducing atmosphere reached 1025° C. It is obvious from the view of FIGS. 4*a* and 4*b* that, as a result of heating the steel sheet up to 1000° C. in the reducing atmosphere containing no nitrogen, the grain size distribution is not uniform, in that excessively coarsened crystal grains were produced in the surface layers of the steel sheet. The coarsened grains shown in FIG. 4*a* are much coarser than those shown in FIG. 3*a*. The resultant secondary recrystallized steel sheet exhibited a macro structure as shown in FIG. 4*c* and a poor $B_8$ 5. In view of FIG. 4*c*, it is clear that the macro structure contains very fine grains which have not been secondary recrystallized.

In Comparison Example 3, the steel sheet was heated in a reducing atmosphere consisting of hydrogen alone until the reducing atmosphere reached 1000° C. Then, the steel sheet was further heated in another reducing atmosphere consisting of 75% hydrogen and 25% nitrogen until the temperature of this reducing atmosphere reached 1200° C. The resultant secondary recrystallized steel sheet exhibited a poor $B_8$ of 1.85 and a macro structure similar to that shown in FIG. 4*c*.

In Comparision Example 4, the steel sheet was heated in a reducing atmosphere consisting of hydrogen alone until the temperature of the reducing atmosphere reached 1200° C. The resultant secondary recrystallized steel sheet contained fine crystal grains and exhibited a poor $B_8$ of 1.80.

What we claim is:

1. A process for producing a grain oriented electrical silicon steel sheet containing aluminium and having an extremely high magnetic flux density, which process comprises secondary recrystallization annealing of a silicon sheet containing aluminium, which has been cold rolled and, then, decarburization annealed, in a reducing atmosphere, and which process is characterized in that in said secondary recrystallization annealing operation, during the time of elevating the temperature of said reducing atmosphere to a level within a range of from 850° to 950° C., the content of nitrogen in said reducing atmosphere is limited to such an extent that the partial pressure of nitrogen is 20% or less based on the entire pressure of said reducing atmosphere, and then, during the time of elevating the temperature of said reducing atmosphere from a level at which the secondary recrystallization of said steel sheet is started to a level at which the secondary recrystallization of said steel sheet is completed, the content of nitrogen in said reducing atmosphere is maintained at such a level that the partial pressure of nitrogen is at least 3% based on the entire pressure of said reducing atmosphere.

2. A process as claimed in claim 1, wherein the content of nitrogen in said reducing atmosphere is zero during the time of elevating the temperature to a level within a range of from 850° to 950° C.

3. A process as claimed in claim 1, wherein during the time of elevating the temperature from the secondary recrystallization starting level to the secondary recrystallization completing level, the partial pressure of nitrogen in said reducing atmosphere is maintained at 10% or more based on the entire pressure of said reducing atmosphere.

* * * * *